US007005152B2

(12) United States Patent
Landau

(10) Patent No.: US 7,005,152 B2
(45) **Date of Patent: *Feb. 28, 2006**

(54) RECEPTACLE CAP HAVING AROMATIC PROPERTIES

(76) Inventor: Steven Landau, 425 Old York Rd., Jenkintown, PA (US) 19046

( * ) Notice: Subject to any disclaimer, the term of this patent is extended or adjusted under 35 U.S.C. 154(b) by 316 days.

This patent is subject to a terminal disclaimer.

(21) Appl. No.: 10/211,537

(22) Filed: Aug. 5, 2002

(65) Prior Publication Data

US 2002/0190023 A1 Dec. 19, 2002

Related U.S. Application Data

(63) Continuation-in-part of application No. 08/797,593, filed on Feb. 7, 1997, now abandoned.

(51) Int. Cl.
*B65D 85/72* (2006.01)

(52) U.S. Cl. ..... 426/115; 426/106; 426/112; 426/117; 426/131; 426/132

(58) Field of Classification Search ..... 426/85, 426/106, 112, 115, 117, 131, 132; 215/386–389; 220/703, 707, 709; 210/266, 282, 473, 475
See application file for complete search history.

(56) References Cited

U.S. PATENT DOCUMENTS 2,357,258 A * 8/1944 Harris ..... 426/112
2,836,321 A * 5/1958 Soltesz et al. ..... 215/11.1
3,043,464 A * 7/1962 Cerasari ..... 215/11.1
3,413,128 A * 11/1968 Steinbarth et al. ..... 426/115
3,463,361 A * 8/1969 Cook et al. ..... 222/144.5
3,567,119 A * 3/1971 Wilbert ..... 239/6
3,599,859 A * 8/1971 Maierson ..... 206/216
3,603,454 A * 9/1971 Raaf ..... 206/205
3,615,595 A * 10/1971 Guttag ..... 426/85
3,717,476 A * 2/1973 Harvey ..... 426/85
3,730,737 A * 5/1973 Harvey et al. ..... 426/115
3,743,520 A * 7/1973 Croner ..... 426/87
4,540,721 A * 9/1985 Staller ..... 523/102
4,687,203 A * 8/1987 Spector ..... 273/157 R
4,717,017 A * 1/1988 Sprinkel et al. ..... 206/264
4,720,423 A * 1/1988 Fraser ..... 428/313.5
4,921,713 A * 5/1990 Fowler ..... 426/85
4,990,345 A * 2/1991 Webb ..... 426/123
5,018,974 A * 5/1991 Carnahan et al. ..... 434/98
5,076,425 A * 12/1991 Plone ..... 206/220
5,085,330 A * 2/1992 Paulin ..... 215/6

(Continued)

FOREIGN PATENT DOCUMENTS

GB 1558960 A * 1/1980

(Continued)

*Primary Examiner*—Milton I. Cano
*Assistant Examiner*—Robert Madsen
(74) *Attorney, Agent, or Firm*—Lamorte & Associates

(57) ABSTRACT

A device and method for adding the perception of flavoring to a product that is consumed from a receptacle. The device is a cover for a receptacle, wherein a person can drink from a receptacle through the structure of the cover. At least a portion of the receptacle cover is scented with a desired fragrance. Furthermore, the scented portion of the receptacle cover enters the mouth when a person is drinking through the receptacle cover. As the scented portion of the receptacle cover is taken within the mouth, the receptacle cover scents the air contained within the mouth. By scenting the air inside the mouth, the nose is saturated by the desired fragrance and a more effective olfactory sense deception is obtained.

10 Claims, 6 Drawing Sheets

U.S. PATENT DOCUMENTS 5,085,335 A * 2/1992 Carbaugh ..... 220/709
5,211,973 A * 5/1993 Nohren, Jr. ..... 426/82
5,236,415 A * 8/1993 Stallings ..... 604/514
5,249,676 A * 10/1993 Ashcraft et al. ..... 206/264
5,297,732 A * 3/1994 Hahn ..... 239/55
5,431,276 A * 7/1995 Lialin ..... 206/222
5,529,179 A * 6/1996 Hanson ..... 206/219
5,635,229 A * 6/1997 Ray ..... 426/112
5,640,931 A * 6/1997 Markham ..... 119/711
5,707,353 A * 1/1998 Mazer et al. ..... 604/83
5,932,262 A * 8/1999 Little ..... 426/420
6,045,833 A * 4/2000 Landau ..... 426/2
6,102,224 A * 8/2000 Sun et al. ..... 215/252
6,112,749 A * 9/2000 Hall et al. ..... 128/898
6,165,523 A * 12/2000 Story ..... 426/112
6,221,416 B1 * 4/2001 Nohren, Jr. ..... 426/394
2004/0028779 A1 * 2/2004 Landau ..... 426/132

FOREIGN PATENT DOCUMENTS

JP 59155451 A * 9/1984
JP 63265926 A * 11/1988
JP 03289452 A * 12/1991
JP 2000085777 A * 3/2000

* cited by examiner

RECEPTACLE CAP HAVING AROMATIC PROPERTIES

RELATED APPLICATIONS

This application is a continuation-in-part of U.S. patent application Ser. No. 08/797,593, entitled BOTTLE CAP CLOSURE WITH FLAVORING COMPONENT, filed on Feb. 7, 1997 now abandoned.

BACKGROUND OF THE INVENTION

1. Field of the Invention

The present invention relates to receptacles for holding drinkable fluids, such as cups, cans and bottles. More specifically, the present invention relates to such receptacles that contain a fragrance intended to enhance the flavor of the fluid drunk from those receptacles.

2. Prior Art Statement

Many people carry bottles of water with them as they exercise, travel or otherwise leave the confines of their home. One reason water is so often selected is that pure water does not need refrigeration and has no ingredients that can spoil. Consequently, a person can open and close the bottle of water numerous times without concern as to the quality of the contents.

The one disadvantage of drinking water is that the water has no flavor. As a result, the water is drunk mostly for the purposes of hydration. Over the years, devices have been developed that add flavor to water as the water is being drunk. Most of these prior art devices come in the form of straws, wherein a flavoring is present within the straw. As water is drawn through the straw, the water absorbs the flavoring and the person drinking the water tastes the flavoring. Such prior art devices are exemplified by U.S. Pat. No. 5,094,861 to D'Auguste, entitled FLAVORED DRINKING STRAW; U.S. Pat. No. 3,615,595 to Guttag, entitled FLAVORED DRINKING STRAW; and U.S. Pat. No. 4,921,713 to Fowler, entitled VERSATILE CONTROLLED FLAVOR STRAW ASSEMBLY.

Another type of prior art straw that adds flavoring to a drink is shown in U.S. Pat. No. 3,545,980, to Stanger, entitled COMBINATION STRAW AND FLAVORING. In the Stanger patent, the fluid flowing through the straw does not contact the flavoring. Rather, the flavoring material is placed in the mouth where the saliva of the mouth dissolves the flavoring and the flavoring then mixes with the fluid passing into the mouth.

The problems with the straw-based prior art flavoring devices are that in order to use such devices, the straw must be placed into the liquid being drunk. This requires a person to either bring his/her own straw or purchase a straw in addition to the beverage being consumed. Furthermore, even if such a straw were readily available, many water bottles have caps that do not have openings large enough to pass a straw through. As a result, the water would have to be poured into a container with a larger opening before it can be drunk. Another disadvantage of straw-based prior art flavoring devices is that they add calories and/or chemicals to the water. If a person does not wish to consume such calories or chemicals, then that person can not use the straw and must drink the water unflavored.

In an attempt to flavor water without adding additives to the water, devices have been developed that depend upon the physiological phenomenon of olfactory sense deception. A person's sense of taste is mostly regulated by that person's sense of smell. It is a well known physiological phenomenon that a person who smells a strong aroma while eating or drinking will believe that the food or drink being consumed is flavored in a manner corresponding to that smell. In a process not fully understood by science, the human brain receives sensory input from both the nose and the mouth. If the sensory inputs do not correspond, the signals are mixed by the brain. As a result, the brain is tricked into believing that the taste of the food or drink being consumed is the source of the smell. The brain therefore assigns a false flavor to the food or drink being consumed that corresponds to that smell. For the purpose of this disclosure, such a physiological phenomenon is referred to as olfactory sense deception.

U.S. Pat. No. 5,635,229 to Ray, entitled BEVERAGE CONTAINER INCLUDING AN AFFIXED SCENT DISBURSEMENT MEANS FOR ENHANCING PERCEIVED FLAVOR OF THE BEVERAGE, shows a prior art device that relies upon olfactory sense deception. In the referenced Ray patent, an aromatic ring is placed around the neck of a bottle. As a person drinks from the bottle, they smell the aromatic ring, wherein olfactory sense deception is hopefully induced.

The olfactory sense receptors in the sinuses receive scents in two different ways. The first way is when a person inhales through his/her nose. The second way is when air enters the sinus cavity from the back of the mouth. A problem associated with prior art devices, such as that described in the Ray patent, is that the aromatic source is located only outside the nose. Therefore, the scent of the aromatic source is only perceived when a person inhales through his/her nose. Furthermore, the aromatic source of the Ray patent is only located outside of the nose, while a person is in the process of drinking.

Humans are born with the ability to breath and drink simultaneously. However, this ability is lost shortly after infancy as the anatomy of the body changes. As such, most all people over the age of two cannot drink and breath simultaneously. As such, it is not possible for a person to breath through his/her nose at the exact moment that he/she is drinking. As a result, prior art devices that position a scented object outside the nose only while a person is drinking are fundamentally flawed. Additionally, as a person in drinking or eating, the scent of the material being consumed travels into the sinus from within the mouth. Consequently, the true smell of the material being consumed is smelled and the degree of olfactory sense deception is decreased.

A need therefore exists in the prior art for a device capable of flavoring a consumable product by using a more effective method of olfactory sense deception, whereby a scent can be introduced into the sinus cavity through the mouth. This need is met by the present invention as described and claimed below.

SUMMARY OF THE INVENTION

The present invention is a device and method for adding the perception of flavoring to a product that is consumed from a receptacle. The device is a cover for a receptacle, wherein a person can drink from a receptacle through the structure of the cover. The receptacle cover is scented with a desired fragrance. Furthermore, the receptacle cover is shaped so that a portion of the cover enters the mouth when a person is drinking through the receptacle cover. A person who consumes a product directly from the receptacle will bring the receptacle cover to his/her mouth. As the receptacle cover is taken within the mouth, the receptacle cover scents the air contained within the mouth. By scenting the air inside the mouth, the sinuses are internally exposed to the desired fragrance and a more effective olfactory sense deception is obtained.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
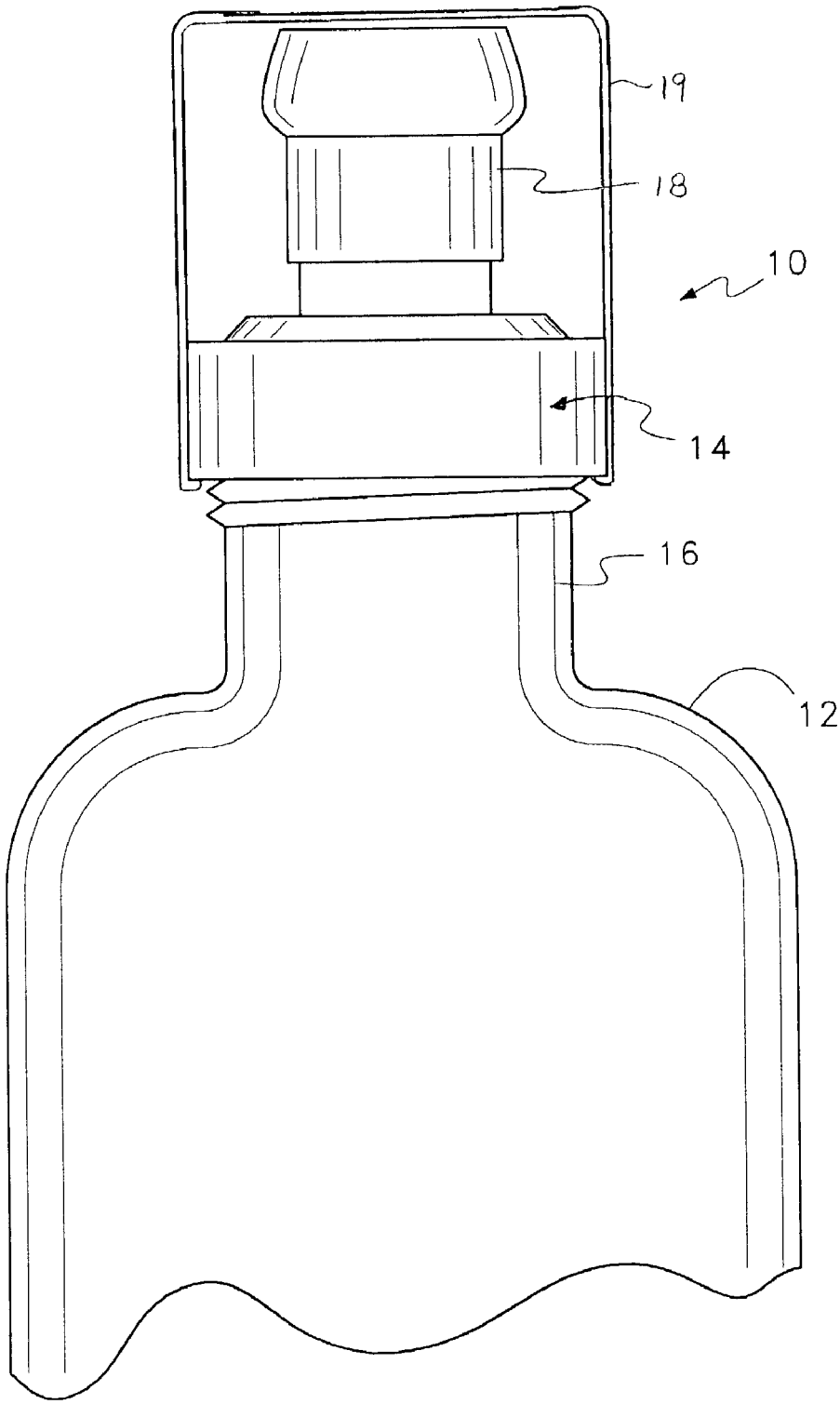
FIG. 1 is side view of a water bottle receptacle having a cap element made from fragrance impregnated plastic in accordance with the present invention.

Referring to FIG. 1, a bottle receptacle 10 is shown. The bottle receptacle 10 includes a bottle 12 for holding a liquid such as water and a cap element 14 for accessing the liquid in the bottle 12. The bottle 12 has an open end at the top of a threaded neck 16. The cap element 14 threads around the threaded neck 16 of the bottle 12, thereby selectively obstructing the flow of liquid into and out of the bottle 12. In the shown embodiment, the cap element 14 has an integrated on/off valve that is controlled by the selective positioning of a nipple head 18 on the cap element 14. Cap elements of a similar construction are well known and commonly used in the prior art. A full description of the function of the cap element is made in U.S. patent application Ser. No. 08/797,593, entitled BOTTLE CAP CLOSURE WITH FLAVORING COMPONENT, filed on Feb. 7, 1997, from which this application is a continuation-in-part.

In the present invention, at least the nipple head 18 is molded from a plastic that is fragranced. The plastic can be fragranced by mixing fragranced oils or resins with the plastic prior to molding. In other techniques, the plastic can be fragrances by mixing fragranced oils with the color additives of the plastic. In yet another technique, the plastic can be reduces into a molten form and mixed with liquid fragrance oils in a liquid injection process. Regardless to the method that is used to produce the plastic, the plastic once molded and cured emits a strong perceivable fragrance.

Although only the nipple head 18 need be fragranced, in the shown embodiment both the base segment and the nipple head of the cap element 14 are molded from plastic that is impregnated with a fragrance. The fragrance is preferably that of a consumable product, such as a fruit, confection or beverage. The composition of fragrance impregnated plastic is known in the prior art. The amount of fragranced oil or resin per unit weight in the plastic composition depends upon the type of plastic being impregnated and the potency of the fragrance being used. In any such composition, the amount of fragrance added to the plastic should be sufficient to provide a strongly perceivable aroma when the nipple head 18 is placed within the mouth.

Since the nipple head 18 of the cap element 14 is both molded from a fragrance impregnated plastic, it will be understood that the air within and around the nipple head 18 contains the aroma of the fragrance impregnated material. Prior to the cap element 14 being used by a consumer, a protective cap 19 cover is placed around the cap element 14. The protective cover keeps the cap element sanitary and prevents any significant concentration of fragrance from evaporating out of the cap element until the protective cover is removed.

Figure 2:
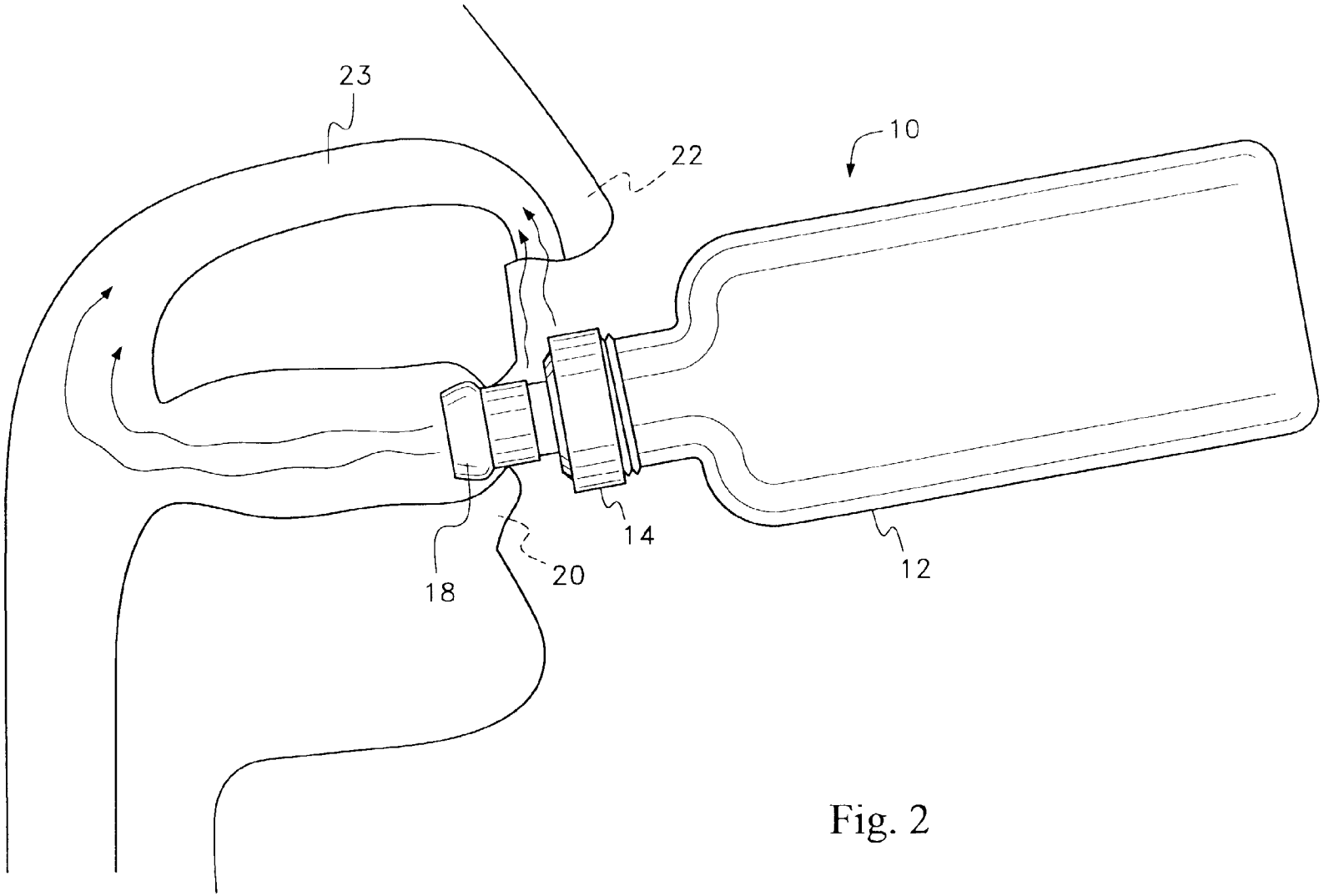
FIG. 2 is a side view of the water bottle receptacle of in FIG. 1, shown in conjunction with a person's face to show how the cap element both enters the mouth and comes into close proximity of the nose when a person drinks.

Referring to FIG. 2, it can be seen that when a person wants to drink from the bottle receptacle 10, the protective cover 19 (FIG. 1) is removed. The cap element 14 is opened and is then brought into contact with the mouth 20. When the cap element 14 is brought to the mouth 20, at least a portion of the nipple head 18 passes into the mouth 20. Furthermore, as the cap element 14 is brought into contact with the mouth 20, the nipple head 18 is caused to pass under the nose 22.

As the nipple head 18 passes under the nose 22 and into the mouth 20, a strong aroma is provided to the air surrounding the nose 22. As such, should a person inhale through his/her nose 22 between swallows, the intake of air contains the desired aroma. Furthermore, since a portion of the nipple head 18 of the cap element 14 is present inside the mouth 20, the nipple head 18 is also emitting an aroma within the mouth cavity. The aroma emitted by the nipple head 18 combines with the air from within the receptacle that has already been scented by passing through the nipple head 14. The scented air fills the area within the mouth 20, wherein the aroma enters the sinus cavity 23 from the mouth. The aroma filled air contained within the mouth 20 also mixes with exiting air as a person exhales through his/her nose 22. Furthermore, small amounts of the aroma filled air are swallowed with the liquid being consumed. As a result, the aroma is contained in any air that is belched and exhaled through the nose 22.

The saturation of the air within the mouth 20 and the air surrounding the nose 22 with the aroma greatly increases the ability of a person to perceive the aroma both immediately before and immediately after swallowing. As a result, the perception of the aroma dominates the natural aroma of the liquid being drunk and a more complete olfactory sense deception occurs.

As olfactory sense deception occurs, the person drinking the fluid perceives a flavor in the fluid that is not actually contained in that fluid. If the fluid being drunk is pure water, the degree of olfactory sense deception is enhanced because the water does not have a strong aroma or flavor of its own to contradict the perceived flavor created by the scented cap element 14. As a result, a person drinking a bottle of pure water will believe that the water being consumed is flavored even though no flavoring or other chemicals have been added to the water.

In the field of bottled water, it is a common practice to oxygenate water prior to bottling. One disadvantage of oxygenating water is that tends to more readily absorb a plastic flavor if stored in a plastic receptacle. By storing water in a receptacle made from a fragrance impregnated plastic, the scent of the plastic will be absorbed by the water. This will provide the water with a favorable aftertaste rather than an undesired plastic aftertaste.

Figure 3:
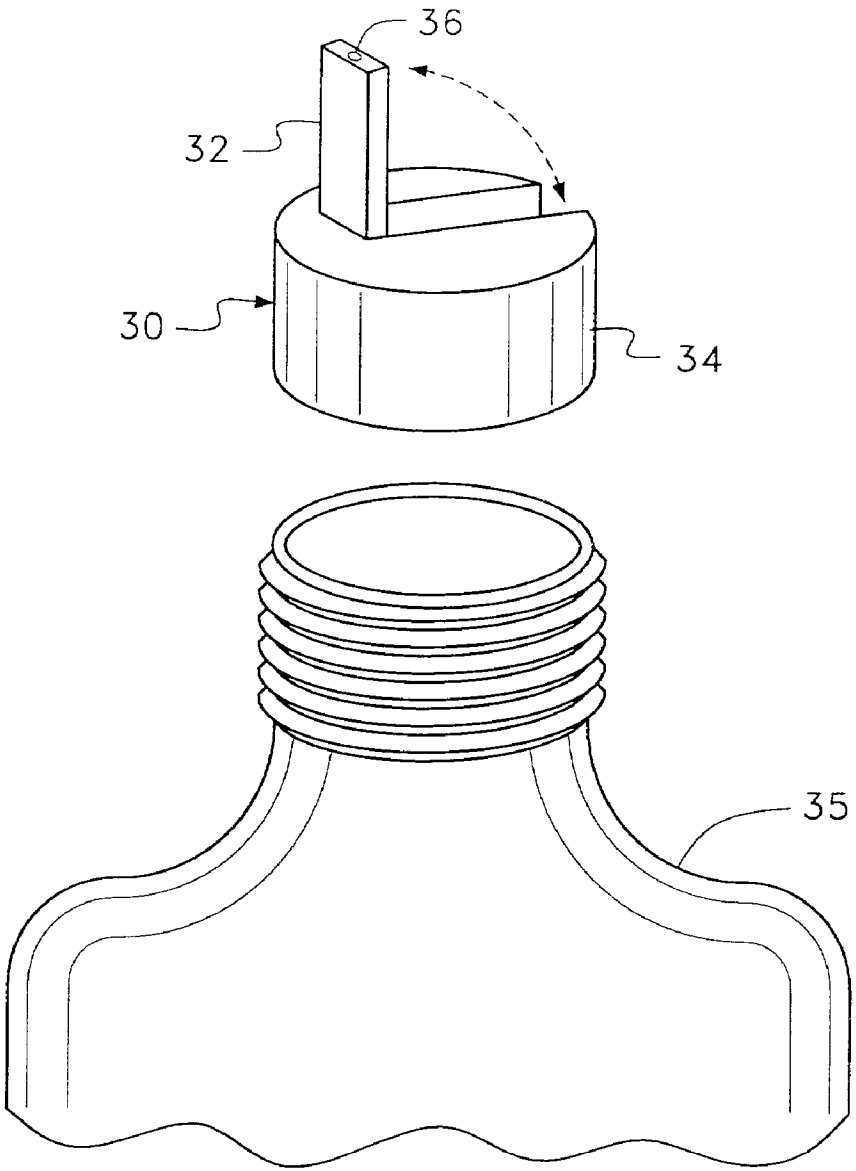
FIG. 3 is a perspective view of a first alternate embodiment of cap element in accordance with the present invention.

Referring to FIG. 3, a bottle cap 30 is shown having an integral flip-up straw element 32. Bottle caps of a similar construction are commonly used to cover containers of consumable fluid. The bottle cap 30 includes a plastic base 34 that threadably attaches to the neck of a bottle 35. The integral flip-up straw 32 is pivotably attached to the cap base 34. The flip-up straw 32 defines a conduit 36 that is open when the straw 32 is extended up and is closed when the straw 32 is folded down. To drink through the bottle cap 30, a person extends the straw 32 upwardly and drinks through the straw 32.

The flip-up straw 32 and, optionally, the cap base 34 are fabricated from a fragrance impregnated plastic. The straw 32 is placed within the mouth when a person is drinking. As a result, fragrance impregnated plastic is positioned within the mouth and when a person drinks. The aroma of the plastic therefore fills the air within the mouth, thereby leading to a more effective degree of aroma saturation. This results in a more effective degree of olfactory sense deception for the reasons previously described.

Figure 4:
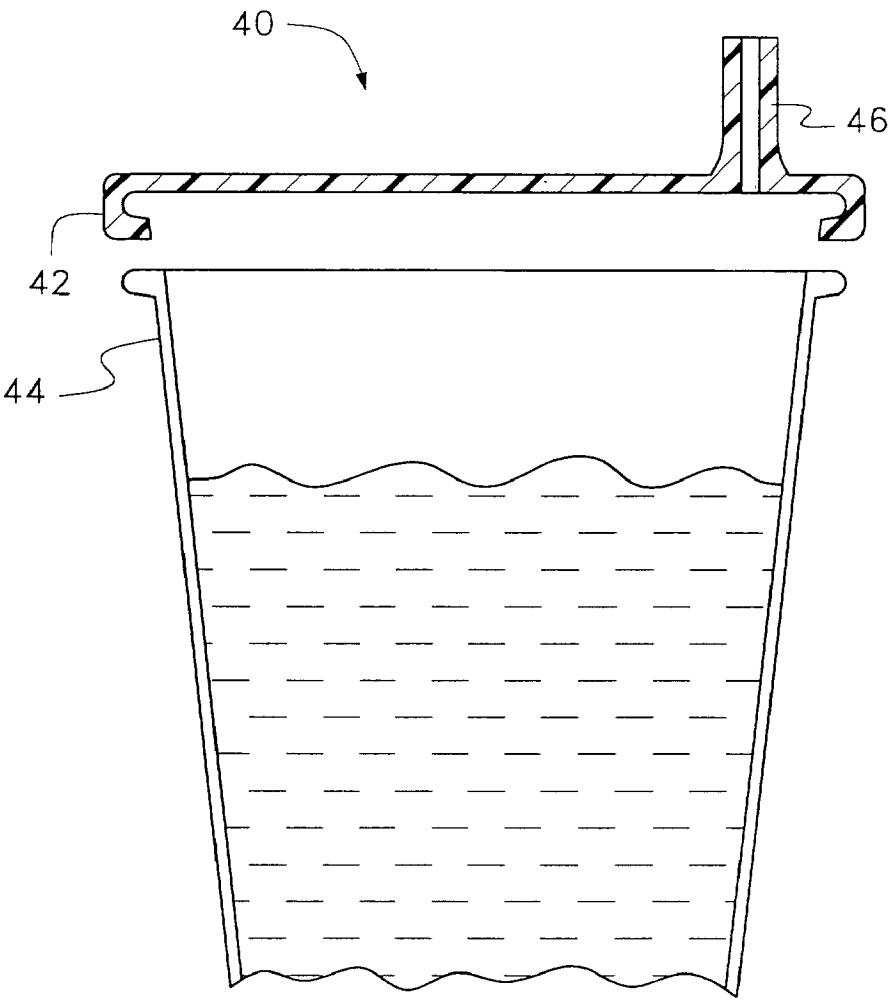
FIG. 4 is a perspective view of a second alternate embodiment of cap element in accordance with the present invention.

Referring to FIG. 4, a child's drinking cup assembly 40 is shown. The drinking cup assembly 40 contains a lid 42 that covers the base cup 44. An elongated conduit 46 extends upwardly from the lid 42. The elongated conduit 46 passes into a child's mouth when the child is drinking through the lid 42.

In the shown embodiment, at least the elongated conduit 46 is made of fragrance impregnated plastic. Accordingly, when a child drinks from the cup assembly, part of the scented material of the lid is positioned within the mouth. The aroma of the material therefore fills the air within the mouth, thereby leading to a more effective degree of aroma saturation. Additionally, the air contained within the base cup 44 is scented by its close proximity with the lid 42. As liquid is drunk from the cup assembly, some of the scented air from within the base cup travels with the liquid into the mouth. The scented air mixes with the air within the mouth, thereby resulting in a stronger scent present within the mouth. This results in a more effective degree of olfactory sense deception for the reasons previously described.

Figure 5:
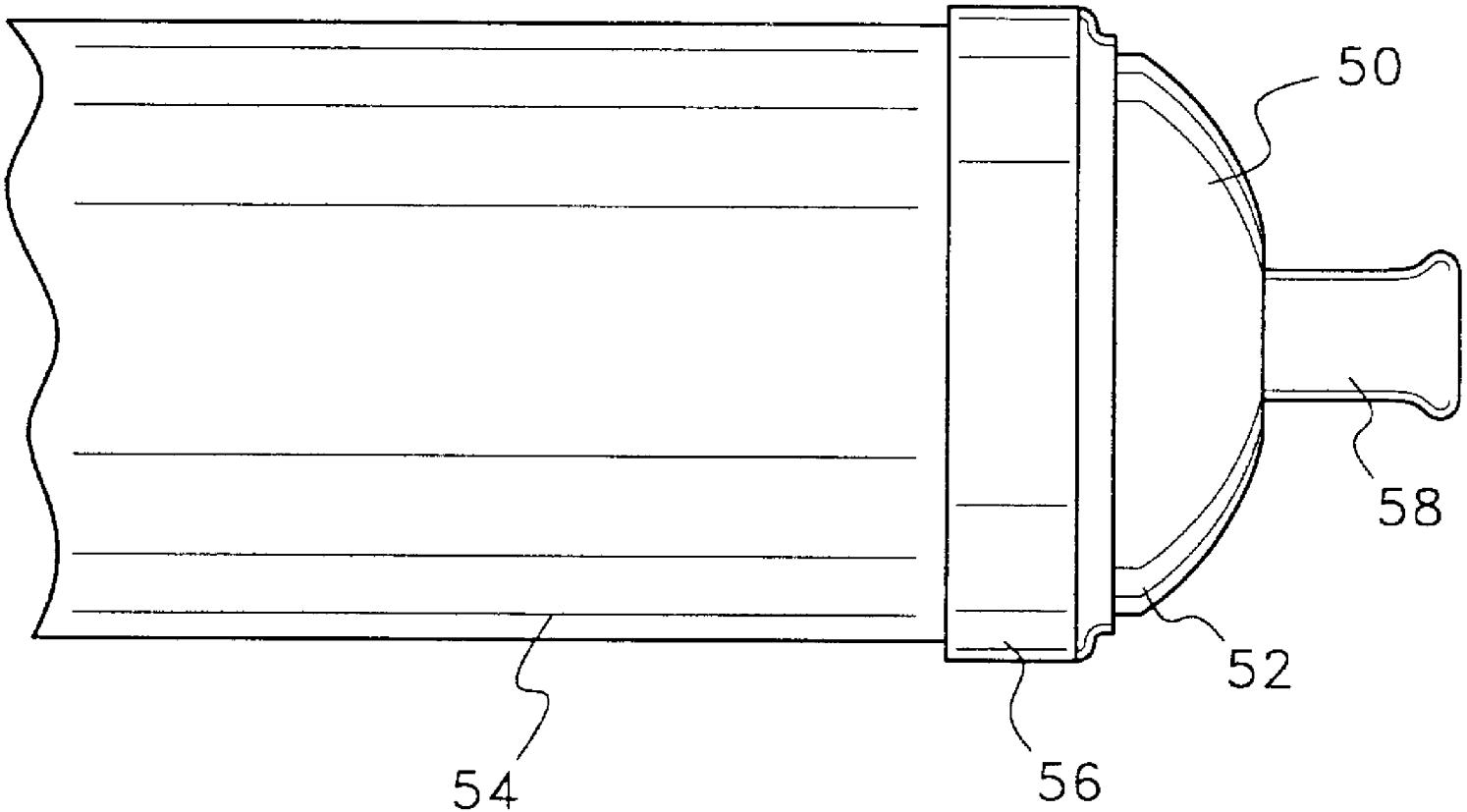
FIG. 5 is a perspective view of a third alternate embodiment of cap element in accordance with the present invention.

Lids similar to that shown in FIG. 5 are also used to cover beverage can, soup cups and hot beverage cups. Thus, it should be understood that the application of such a cap to a child's drinking cup is merely exemplary and should not be considered a limitation to the application of such a lid.

Referring to FIG. 5, a plastic bottle nipple 50 is shown. The nipple 50 has a base 52 that is sized to fit on a nursing bottle 54, wherein the base 52 of the nipple is held in place by a collar element 56. The nipple 50 also includes a protruding teat 58 that enters the mouth of a feeding infant. In the shown embodiment, the entire bottle nipple 50, including the teat 58 is made of fragrance impregnated plastic. Accordingly, when a child drinks from the bottle nipple 50, part of the scented nipple material is positioned outside the nose and some of the scented nipple material is held within the mouth. The aroma of the material therefore fills the air within the mouth and the air surrounding the nose, thereby leading to a more effective degree of aroma saturation. Additionally, the air contained within the bottle 54 is scented by its close proximity with the nipple 50. As liquid is drunk from the bottle, the some of the scented air from within the bottle flows with the liquid into the mouth. The scented air mixes with the air within the mouth, thereby resulting in a stronger scent present within the mouth. This results in a more effective degree of olfactory sense deception for the reasons previously described.

Figure 6:
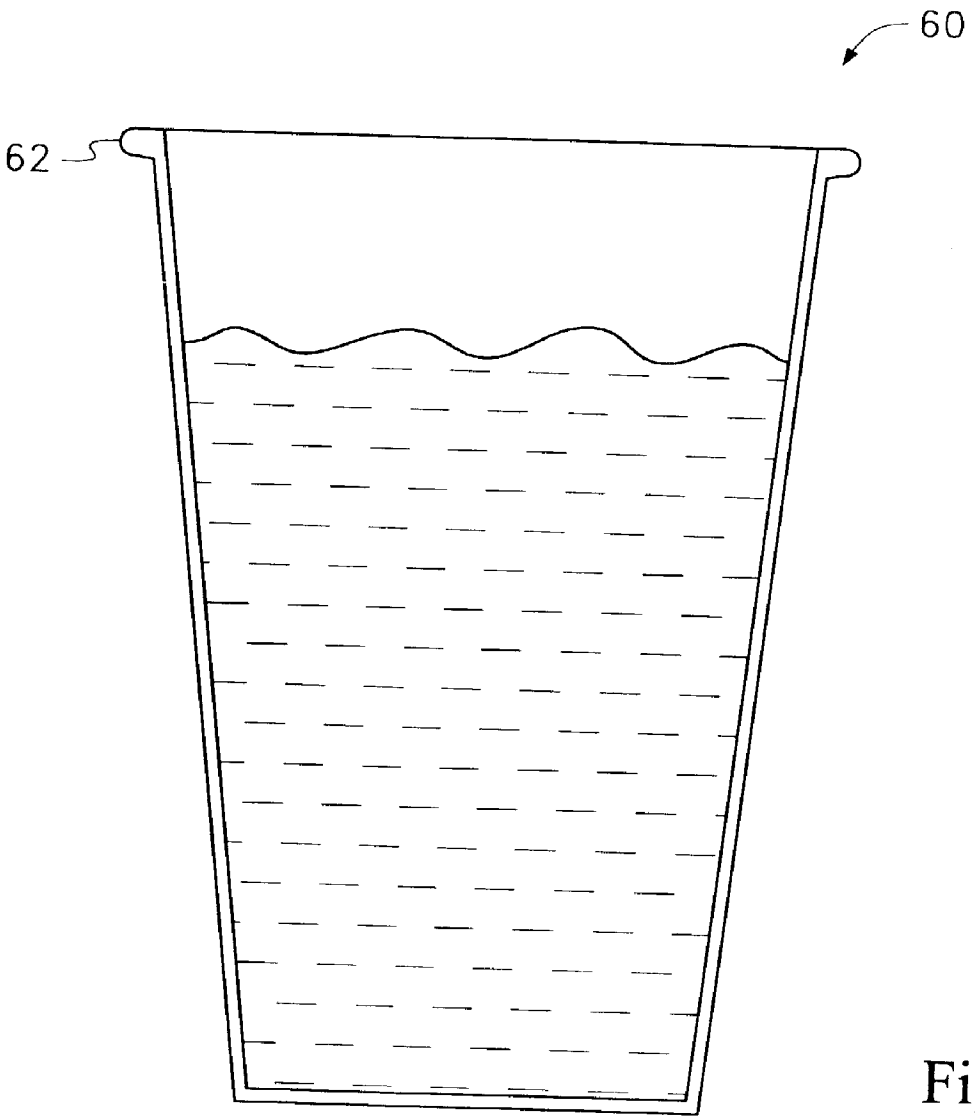
FIG. 6 is a perspective view of a fourth alternate embodiment of cap element in accordance with the present invention.

Referring to FIG. 6, an open cup 60 is shown. The cup 60 can be either entirely made of fragrance impregnated plastic or the cup can be paper based and coated with a fragrance impregnated wax. As a person drinks from the cup, the rim 62 of the cup 60 enters the mouth. The aroma from the material of the cup 60 therefore fills the air within the mouth as well as the air surrounding the nose. This results in a more effective degree of olfactory sense deception for the reasons previously described.

In the embodiments of FIG. 1 through FIG. 5, embodiments of the present invention are shown where a scented plastic lid/cap is used to cover some container. In such applications, it should be understood that the scented plastic used to make the scented lid/cap emits aroma into the confines of the container as well as into the air surrounding the container. Since the area below the lid/cap is a confined area, the concentration of aroma in this area is high. Thus, the air confined within the container is strongly scented with the emitted aroma.

As a person drinks from the container, a person takes some of the scented air from within the container into their mouth. As a consequence a small amount of highly scented air enters the mouth each time a person sips from the lid/cap. This scented air passes quickly up the back of the throat and into the sinuses. Consequently, as soon as a person drinks from a lid/cap of the present invention, olfactory sense deception begins. This ensures that olfactory sense deception begins the moment material is consumed, thus providing false flavor to everything that is consumed.

It will be understood that the embodiments of the present invention described and illustrated herein are merely exemplary and a person skilled in the art can make many variations to the embodiments shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A cap device for covering an open end of a fluid containing receptacle, said device comprising:

a base segment adapted to engage the fluid containing receptacle at a position where said cap device covers the open end of the fluid containing receptacle; and an extension segment extending from said base segment, said extension segment defining a conduit through which fluid flows, wherein at least a portion of said extension segment extends into a person's mouth when fluid from the fluid containing receptacle is drunk through said cap device;

wherein said extension segment is at least partially molded from a plastic impregnated with a fragrance that can be perceived by a person drinking the fluid through said cap device, thereby adding a perception of flavoring to the fluid as it is drunk.

2. The device according to claim 1, further including a mechanism for selectively opening and closing said cap device wherein fluid is free to flow through said extension segment when said cap device is positioned in an open condition and fluid is isolated in said fluid containing receptacle when said cap device is positioned in a closed condition.

3. The device according to claim 1, wherein said fragrance is selected from fruits, confections and flavored beverages.

4. The device according to claim 1, wherein said fluid containing receptacle is a bottle and said cap device is configured as a bottle cap.

5. A beverage receptacle comprising:

a container having an open top end;

a cap that covers said open top end of said container and is adapted to enable fluid to be drunk therethrough, said cap having a first section that passes into a person's mouth when fluid is drunk therefrom, and a second section that remains external of the mouth, wherein at least said first section is fabricated from a plastic impregnated with a fragrance that emanates aroma from said first section in the mouth when a person drinks fluid through said cap, so that a perception of flavoring is added to the fluid as it is drunk.

6. The receptacle according to claim 5, wherein the fragrance contained within said fragrance impregnated plastic is selected from a group consisting of fruits, confections and flavored beverages.

7. The receptacle according to claim 5, wherein said fluid containing receptacle is a bottle and said cap device is configured as a bottle cap.

8. The receptacle according to claim 5, wherein said fluid containing receptacle is a cup and said cap device is configured as a cup lid.

9. The receptacle according to claim 5, wherein said fluid containing receptacle is a bottle and said cap device is configured as a nipple.

10. The receptacle according to claim 5, wherein said cap and said container defines an enclosed space, and said at least one first section emits aroma into said enclosed space.

* * * * *